US005120201A

United States Patent [19]

Tuckey et al.

[11] Patent Number: 5,120,201

[45] Date of Patent: Jun. 9, 1992

[54] BRUSHLESS DC FUEL PUMP RESPONSIVE TO PRESSURE SENSOR

[75] Inventors: Charles H. Tuckey; James L. Thompson, both of Cass City, Mich.

[73] Assignee: Walbro Corporation, Cass City, Mich.

[21] Appl. No.: 628,369

[22] Filed: Dec. 17, 1990

[51] Int. Cl.[5] ..... F04B 49/06

[52] U.S. Cl. ..... 417/366; 417/45

[58] Field of Search ..... 417/43, 366, 45

[56] References Cited

U.S. PATENT DOCUMENTS

| | | | |
|---|---|---|---|
| 3,985,467 | 10/1976 | Lefferson | 417/45 |
| 4,260,333 | 4/1981 | Schillinger | 417/45 |
| 4,352,636 | 10/1982 | Patterson | 417/45 |
| 4,431,953 | 2/1984 | Schray et al. . | |
| 4,728,264 | 3/1988 | Tuckey | 417/44 |
| 4,789,308 | 12/1988 | Tuckey | 417/366 |
| 4,830,576 | 5/1989 | Patrick | 417/45 |
| 4,998,865 | 1/1991 | Nakanishi | 417/366 |

FOREIGN PATENT DOCUMENTS

| | | | |
|---|---|---|---|
| 0156966 | 8/1985 | Japan | 417/45 |

*Primary Examiner*—Louis J. Casaregola

*Assistant Examiner*—David W. Scheuermann

*Attorney, Agent, or Firm*—Barnes, Kisselle, Raisch, Choate, Whittemore & Hulbert

[57] ABSTRACT

A self-contained brushless electric-motor fuel pump for internal combustion engine fuel delivery systems and like applications in accordance with the present invention comprises a housing having a fuel inlet and fuel outlet, and a brushless electric motor with a permanent magnet armature mounted for rotation within the housing and stator windings surrounding the armature within the housing. A pump mechanism is positioned between the fuel inlet and outlet, and is coupled to the armature for corotation with the armature within the housing to pump fuel under pressure from the inlet to the outlet. A pressure sensor is operatively coupled to the fuel outlet within the housing for providing an electrical pressure signal as a function of fuel pressure at the outlet. Pump motor control electronics within the housing includes circuitry for comparing the pressure signal from the pressure sensor to a pump drive reference signal, and providing an error signal as a function of a difference therebetween. Drive current is applied to the stator windings of the motor as a function of such error signal.

3 Claims, 2 Drawing Sheets

BRUSHLESS DC FUEL PUMP RESPONSIVE TO PRESSURE SENSOR

The present invention is directed to fuel delivery systems for internal combustion engines, and more particularly to a self-contained electric-motor fuel pump for use therein.

BACKGROUND AND OBJECTS OF THE INVENTION

In engine fuel delivery systems of current design, fuel is typically fed by a constant-delivery pump from a fuel tank to the engine. A pressure regulator maintains constant fuel pressure at the engine, and excess fuel is returned from the engine to the fuel tank. Such return fuel carries engine heat to the fuel supply tank, and consequently increases temperature and vapor pressure in the fuel tank. Venting of excess vapor pressure to the atmosphere not only causes pollution problems, but also deleteriously affects fuel mileage. Excess fuel tank temperature can also cause vapor lock at the pump, particularly where fuel level is relatively low. Constant pump operation also increases energy consumption, while decreasing both fuel pump life and fuel filter life. It is therefore desirable not only to eliminate the necessity for the fuel return line from the engine to the supply tank (while still maintaining constant fuel pressure at the engine), but also to control pump operation as a function of fuel requirements at the engine both to maintain constant fuel pressure at the engine and to increase pump life.

U.S. Pat. No. 4,728,264 discloses a fuel delivery system in which a d.c. motor fuel pump delivers fuel under pressure from a supply tank to an engine. A pressure-sensitive switch, which may be contained within a unitary pump/motor housing, is responsive to fuel pump output pressure for applying a pulse width modulated d.c. signal to the pump motor, and thereby controlling pump operation so as to maintain constant pressure in the fuel delivery line to the engine independently of fuel demand. U.S. Pat. No. 4,789,308 discloses a self-contained fuel pump that includes an electronic sensor in the pump outlet end cap responsive to fuel outlet pressure for modulating application of current to the pump motor and maintaining a constant pressure in the fuel delivery line to the engine. Copending U.S. application Ser. No. 07/421,810 filed Oct. 16, 1989 discloses a fuel delivery system that includes a unitary fuel pump assembly in which a pressure sensor is coupled to the pump outlet port for measuring fuel delivery pressure. A second sensor is positioned within the fuel tank and is responsive to fuel alcohol concentration. A circuitboard assembly on the pump outlet end cap receives the signals from the pressure and alcohol sensors, and supplies a pulsed d.c. signal to the pump motor having a duty cycle that varies as a combined function of the pressure and alcohol concentration sensor output signals so as to maintain constant fuel pressure at the engine while automatically compensating quantity of fuel delivered by the pump for differing fuel alcohol concentrations. The noted patents and application are all assigned to the assignee hereof.

Although the fuel delivery systems and pumps disclosed in the noted patents and application address and overcome a number of problems theretofore extant in the art, further improvements remain desirable. For example, the preferred embodiments of the pumps disclosed in the noted patents and application employ brush-type d.c. motors with associated commutator brushes and springs for urging the brushes into engagement with the rotating armature. These brushes are subject to wear and failure. It is therefore a general object of the present invention to provide a self-contained electric-motor fuel pump that includes a brushless-type d.c. motor and associated drive electronics with on-board outlet pressure compensation.

SUMMARY OF THE INVENTION

A self-contained brushless electric-motor fuel pump for internal combustion engine fuel delivery systems and like applications in accordance with the present invention comprises a housing having a fuel inlet and fuel outlet, and a brushless electric motor with a permanent magnet armature mounted for rotation within the housing and stator windings surrounding the armature within the housing. A pump mechanism is operatively positioned between the fuel inlet and outlet, and is coupled to the armature for corotation with the armature within the housing to pump fuel under pressure from the inlet to the outlet. A pressure sensor is operatively coupled to the fuel outlet within the housing for providing an electrical pressure signal as a function of fuel pressure at the outlet. Pump motor control electronics within the housing includes circuitry for comparing the pressure signal from the pressure sensor to a pump drive reference signal, and providing an error signal as a function of a difference therebetween. Drive current is applied to the stator windings of the motor as a function of such error signal.

In the preferred embodiment of the present invention, the pump housing takes the form of a pair of spaced end caps having respective inlet and outlet passages extending therethrough, and a case joining the end caps to form the hollow pump housing that contains the motor and pump mechanism. The pressure sensor is mounted on the outlet end cap and operatively coupled to the outlet passage extending therethrough. The pump motor control electronics takes the form of a circuitboard assembly mounted within a cavity on the outlet end cap connected by conductors that extend through the cavity to the pressure sensor and to the motor stator windings. Electrical connectors on the end cap between the circuitboard assembly and the stator windings isolate the outlet end cap cavity in which the circuitboard is mounted from fuel that flows through the hollow pump housing surrounding the motor.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
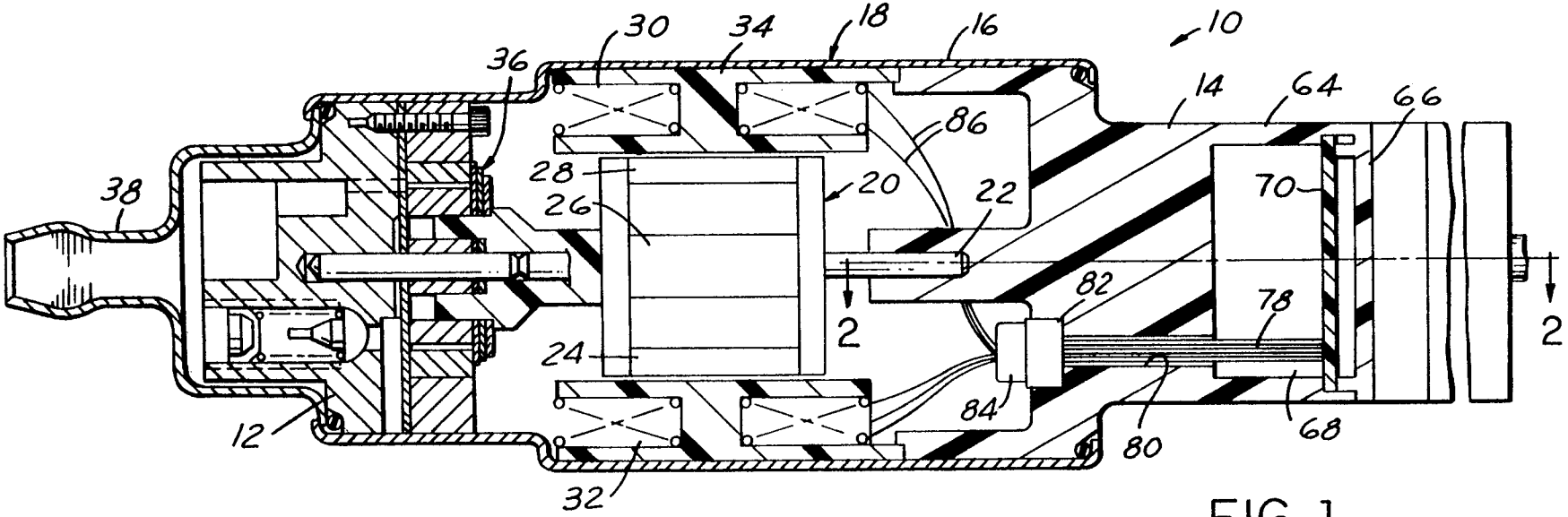
FIG. 1 is a longitudinal bisection of a self-contained brushless electric-motor fuel pump in accordance with a presently preferred embodiment of the invention.

The drawings illustrate a self-contained brushless electric-motor fuel pump 10 in accordance with the present invention as comprising an inlet end cap 12 and an outlet end cap 14 coaxially spaced from each other and interconnected by a cylindrical case 16 to form a hollow pump housing 18. An armature 20 is journaled between end caps 12,14 by a shaft 22 for rotation within housing 18. Armature 20 includes a circumferential array of angularly uniformly spaced outwardly oriented permanent magnets 24,26,28, etc. of successively alternate polarities. Permanent magnet armature 20 is surrounded by a corresponding array of stator windings 30,32, etc. carried by bobbins 34 within case 16 between end caps 12,14. Armature 20 is coupled to a vane or gear system 36 for pumping fuel from an inlet 38 through inlet end cap 12 to the volume of housing 18 surrounding armature 20, and thence through an outlet passage 40 (FIG. 2) in outlet end cap 14 to the engine (not shown) through fuel pressure line 42.

A check valve 44 (FIG. 2) is mounted in passage 40 and is urged against a seat 46 in end cap 14 by a coil spring 48 captured in compression between valve 44 and an outlet fitting 50. Valve 44 helps stabilize fuel flow and prevents reverse flow when pump 10 is turned off. A sleeve 52 on fitting 50 has a passage 54 that extends laterally from main fuel outlet passage 40. A second check valve 56 within passage 54 is urged toward passage 40 against a seat 58 by a coil spring 60 captured in compression between valve 56 and a nut 62. Pressure of spring 60 against valve 56 is set by nut 62 such that an over-pressure in passage 40 and fuel line 42 causes check valve 56 to dump fuel from the pump outlet directly to the surrounding fuel tank (not shown). A sleeve 64 on end cap 14 receives a cover 66 to form a sealed internal volume or cavity 68. An electronic circuitboard assembly 70 is captured by cover 66 against an opposing shoulder within sleeve 64. An electronic pressure sensor 72 is mounted on end cap 14 within cavity 68, and is operatively connected by a passage 74 to end cap outlet passage 40. Pressure sensor 72 is connected to circuitboard assembly 70 by conductors 76 that extend through cavity 68 to provide to the circuitry on assembly 70 an electrical pressure signal that varies as a function of fuel pressure in passage 40. The circuitry on assembly 70 is also connected by conductors 78, which extend through cavity 68 and a second passage 80 in end cap 14, to a connector 82 at the internal face of end cap 14. A mating connector 84 is coupled by conductors 86, which extend through the pump housing cavity, to stator coils 30,32, etc. Connectors 82,84 thus seal outlet end cavity 68 from the internal cavity of the pump housing and fuel flowing therethrough.

Figure 3:
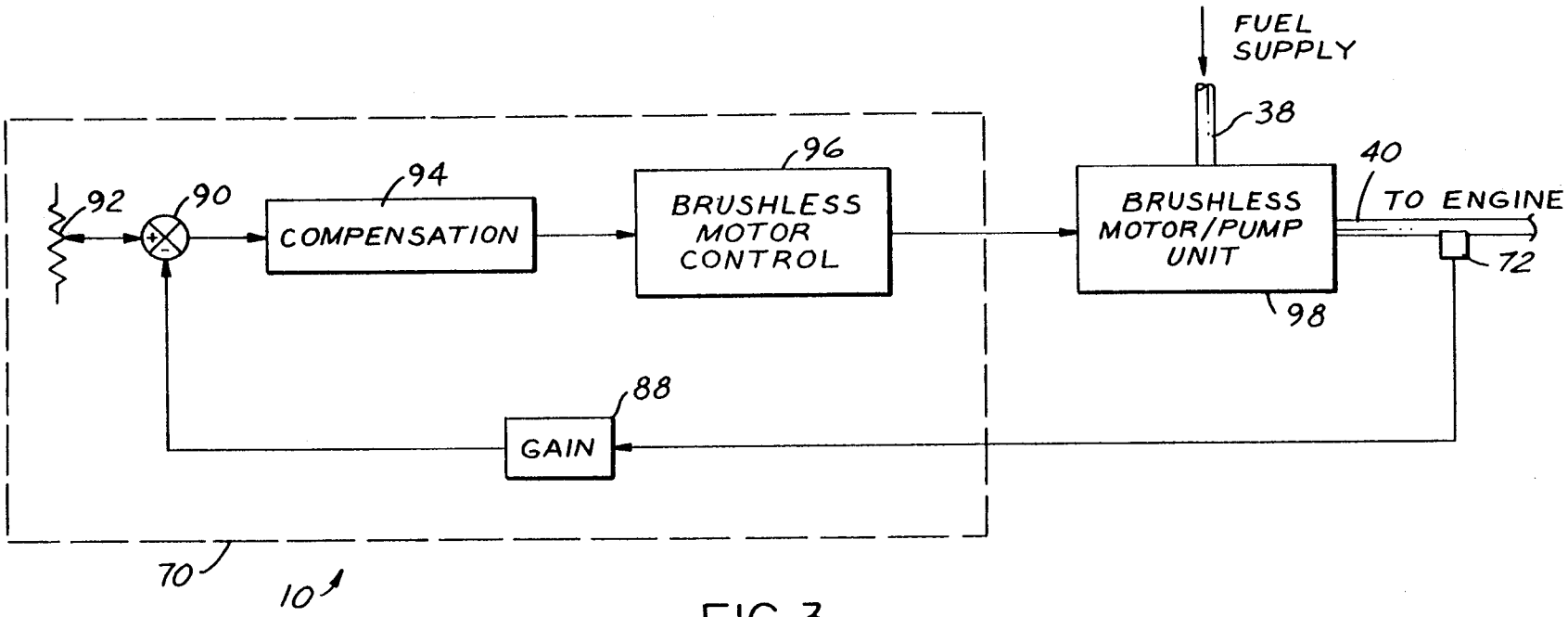
FIG. 3 is a functional block diagram of the fuel pump electronics.

FIG. 3 is a functional block diagram of self-contained pump 10, including the control electronics of circuitboard assembly 70. Pressure sensor 72 is connected through an amplifier or other suitable gain stage 88 to one input of a comparator 90 for supplying a signal indicative of fuel outlet pressure. The second input of comparator 90 receives a pump drive reference signal from a suitable source, such as the variable resistor 92 illustrated in FIG. 3 for supplying a constant pump drive reference signal, or from a suitable external source such as an engine control computer for providing a variable pump drive reference signal. The output of comparator 90, indicative of a difference between the reference and pressure signals, is fed through appropriate compensation circuitry 94 to control circuitry 96 for applying current to the stator windings of the motor/-pump unit 98 as a function of such difference signal. Brushless motor control circuitry 96 may take the form of any suitable circuitry for effectively commutating the drive signals to the stator windings. The stator windings and pump are thus driven as an inverse function the pressure signal from sensor 72. Pump drive electronics 70 may be of either analog or digital construction.

Figure 2:
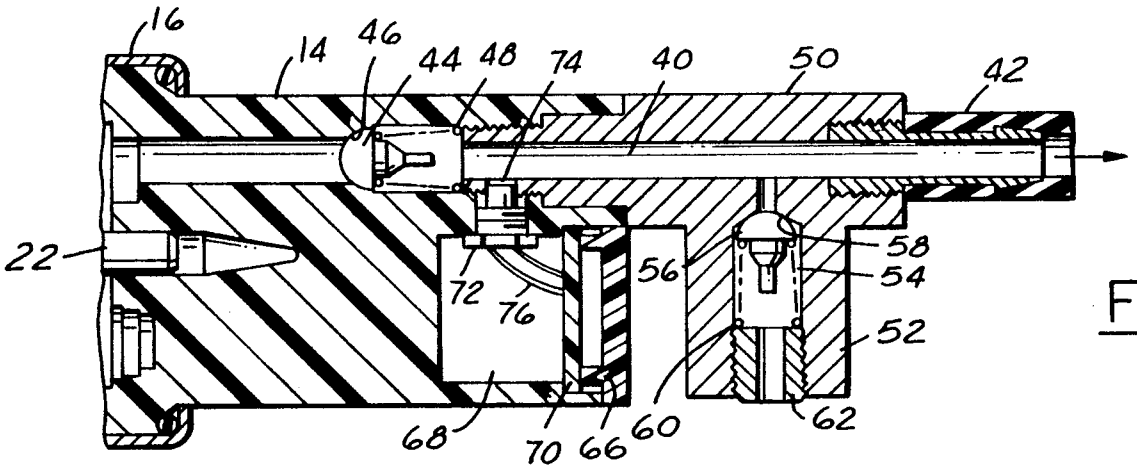
FIG. 2 is a fragmentary sectional view taken substantially along the line 2—2 in FIG. 1.
Figure 4:
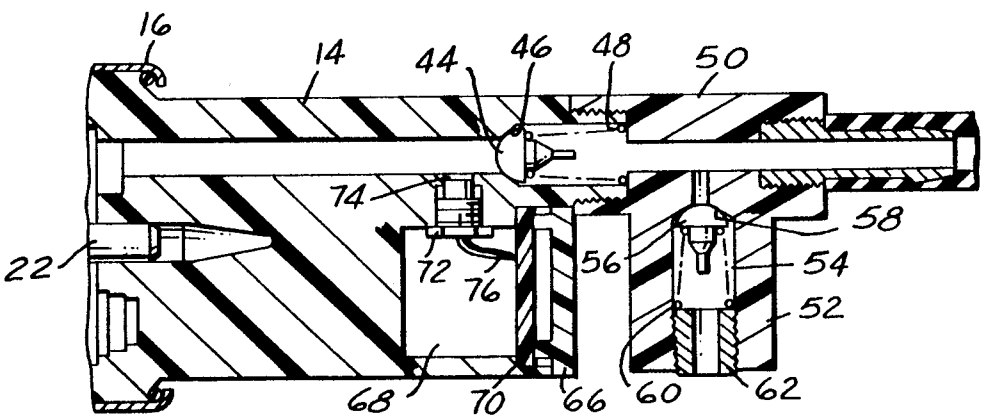
FIG. 4 is a view similar to that of FIG. 2 but showing a modified embodiment of the invention.

FIG. 4 illustrates a modified embodiment of the invention in which pressure sensor 72 is positioned on the upstream or pump side of check valve 44, rather than on the downstream or engine side of the check valve as in FIG. 2. Like reference numerals are employed in FIGS. 2 and 4 to indicate like elements.

We claim:

1. A self-contained brushless electric-motor fuel pump that comprises:

a pair of spaced end caps and a case joining said end cap to form a hollow pump housing, fuel outlet passage means extending through one of said end caps and fuel inlet passage means extending through the other of said end caps, a brushless electric-motor including a permanent magnet armature mounted for rotation within said housing between said end cap and stator windings surrounding said armature between said end cap within said housing, pump means coupled to said armature for rotation within said housing to pump fuel from said inlet passage means through said housing to and through said outlet passage means, a check valve permitting one way flow from said housing to said outlet passage means, a pressure sensor mounted on said one end cap and coupled to said outlet passage means to provide an electrical pressure signal as a function of pressure of fuel at said outlet passage means, and pump motor control means including a circuitboard assembly mounted within a hollow cavity in said one end cap, said hollow cavity being sealed from fuel flow within said housing, means on said assembly for supplying a pump drive reference signal, said pressure sensing means being connected to said circuit board assembly within said cavity such that the connection is sealed from fuel flow within said housing, means on said assembly for comparing said pressure signal to said reference signal to provide an error signal as a function of a difference therebetween, and means extending from said assembly through said one end cap to said stator windings for applying drive current to said stator windings as a function of said error signal.

2. The pump set forth in claim 1 further comprising second passage means in said one end cap, and electrical connection means extending through said second passage means for connecting said stator windings to said circuitboard assembly.

3. The pump set forth in claim 1 wherein said means for supplying said reference signal comprises means for supplying a constant reference signal so as to maintain constant outlet fuel pressure from said pump.

* * * * *